US010933430B2

(12) United States Patent
Wolf et al.

(10) Patent No.: US 10,933,430 B2
(45) Date of Patent: Mar. 2, 2021

(54) DEVICE AND METHOD FOR SEPARATING OFF CONTAMINANTS

(71) Applicant: WOCO Industrietechnik GmbH, Bad Soden-Salmünster (DE)

(72) Inventors: Anton Wolf, Gelnhausen (DE); Pia Engelhardt, Frankfurt am Main (DE); David Kraehenbuehl, Hattenhof (DE); Uwe Ludwig, Bad Soden-Salmünster (DE); Artin Parsegyan, Steinau-Marborn (DE)

(73) Assignee: WOCO Industrietechnik GmbH, Bad Soden-Salmünster (DE)

( * ) Notice: Subject to any disclaimer, the term of this patent is extended or adjusted under 35 U.S.C. 154(b) by 517 days.

(21) Appl. No.: 15/558,933

(22) PCT Filed: Mar. 16, 2016

(86) PCT No.: PCT/IB2016/051481
§ 371 (c)(1),
(2) Date: Sep. 15, 2017

(87) PCT Pub. No.: WO2016/147127
PCT Pub. Date: Sep. 22, 2016

(65) Prior Publication Data

US 2018/0078948 A1 Mar. 22, 2018

(30) Foreign Application Priority Data

Mar. 19, 2015 (DE) ..... 10 2015 104 168
Aug. 3, 2015 (EP) ..... 15179568

(51) Int. Cl.
*B03C 3/08* (2006.01)
*B03C 3/76* (2006.01)
(Continued)

(52) U.S. Cl.
CPC ..... *B03C 3/08* (2013.01); *B03C 3/41* (2013.01); *B03C 3/45* (2013.01); *B03C 3/47* (2013.01);
(Continued)

(58) Field of Classification Search
CPC combination set(s) only.
See application file for complete search history.

(56) References Cited

U.S. PATENT DOCUMENTS 1,992,113 A 2/1935 Evald
4,507,266 A * 3/1985 Satoh ..... H01S 3/038 204/176
(Continued)

FOREIGN PATENT DOCUMENTS

DE 19534950 3/1997
DE 10160198 6/2003
(Continued)

OTHER PUBLICATIONS

International Search Report dated Jun. 10, 2016 for PCT/IB2016/051481.
(Continued)

*Primary Examiner* — Christopher P Jones
*Assistant Examiner* — Sonji Turner
(74) *Attorney, Agent, or Firm* — Brinks Giison & Lione

(57) ABSTRACT

The present invention relates to: a device (1, 101, 151) for separating off liquid and/or particulate contaminants from a gas flow (7, 107), in which a flow path of the gas flow (7, 107) runs between at least one first electrode (9, 31, 109) acting as a counter electrode and at least one second electrode (11, 111, 51, 53, 57, 135, 135', 135", 155) acting as an emitter electrode and having an electrode end (71, 77, 90) oriented in the direction of the first electrode, and a direct-current voltage exceeding the breakdown voltage can be
(Continued)

applied between the first electrode (9, 31, 109) and the second electrode (11, 111, 51, 53, 57, 135, 135', 135", 155) in order to form a stable low-energy plasma (41, 125), wherein the second electrode (11) extends substantially along a first axis (X) in a first direction and the first electrode (31) has at least one plateau region (33) which is arranged opposite the second electrode (11) and which extends at least regionally in a first plane running substantially perpendicular to the first direction (X); and a method for operating such a device.

23 Claims, 8 Drawing Sheets

(51) Int. Cl.

| | |
|---|---|
| ***B03C 3/45*** | (2006.01) |
| ***B03C 3/41*** | (2006.01) |
| ***B03C 3/47*** | (2006.01) |
| ***B03C 3/74*** | (2006.01) |
| ***B03C 3/88*** | (2006.01) |

(52) U.S. Cl.
CPC ..... *B03C 3/74* (2013.01); *B03C 3/743* (2013.01); *B03C 3/763* (2013.01); *B03C 3/88* (2013.01)

(56) References Cited

U.S. PATENT DOCUMENTS

| | | | | |
|---|---|---|---|---|
| 5,476,539 | A * | 12/1995 | Suzuki | B01D 53/32 96/44 |
| 6,119,455 | A * | 9/2000 | Hammer | B01D 53/32 204/177 |
| 6,632,267 | B1 * | 10/2003 | Ilmasti | B03C 3/16 95/59 |
| 7,316,735 | B2 * | 1/2008 | Tomimatsu | B03C 3/41 55/DIG. 38 |
| 7,753,994 | B2 * | 7/2010 | Motegi | B01D 53/32 313/311 |
| 7,758,675 | B2 * | 7/2010 | Naito | B01D 53/32 55/DIG. 38 |
| 8,308,846 | B2 * | 11/2012 | Op de Laak | B03C 3/68 95/5 |
| 8,696,996 | B2 * | 4/2014 | Albrecht | A61L 9/22 422/186.04 |
| 9,604,228 | B2 * | 3/2017 | Ursem | B03C 3/47 |
| 2007/0256563 | A1 | 11/2007 | Volodina et al. | |

FOREIGN PATENT DOCUMENTS

| | | | |
|---|---|---|---|
| DE | 102005023521 | | 6/2006 |
| DE | 602004000467 | | 9/2006 |
| DE | 102011007470 | | 10/2012 |
| DE | 102011053578 | | 3/2013 |
| JP | 2000051735 | A * | 2/2000 |
| WO | WO 2008/145251 | | 12/2008 |

OTHER PUBLICATIONS

Written Opinion dated Jun. 10, 2016 for PCT/IB2016/051481.
German Examination Report dated Nov. 11, 2015 for DE 102015104168.5.
Preliminary Report on Patentability dated Feb. 28, 2017 for PCT/IB2016/051481.
Translation of Preliminary Report on Patentability dated Sep. 21, 2017 for PCT/IB2016/051481.

* cited by examiner

DEVICE AND METHOD FOR SEPARATING OFF CONTAMINANTS

CROSS REFERENCE TO RELATED APPLICATION

This application is the National Phase application of International Application No. PCT/162016/051481, filed Mar. 16, 2016, which designates the United States and was published in English, and which claims priority to German Application No. 102015104168.5, filed Mar. 19, 2015, and European Patent Application No. 15179568.9, filed Aug. 3, 2015. These applications, in their entirety, are incorporated herein by reference.

The present invention relates to: a device for separating off liquid and/or particulate contaminants from a gas flow, in which a flow path of the gas flow runs between at least one first electrode acting as a counter electrode and at least one second electrode acting as an emitter electrode and having an electrode end oriented in the direction of the first electrode, and a direct-current voltage exceeding the breakdown voltage can be applied between the first electrode and the second electrode in order to form a stable low-energy plasma; and to a method for operating such a device.

Such generic separators for separating off contaminants from a gas flow—in particular, blow-by gases of a motor vehicle—are known in the prior art. For example, DE 10 2011 053 578 A1 discloses such a generic device.

FIG. 1 illustrates a schematic cross-sectional view of the device disclosed in DE 10 2011 053 578 A1.

Figure 1:
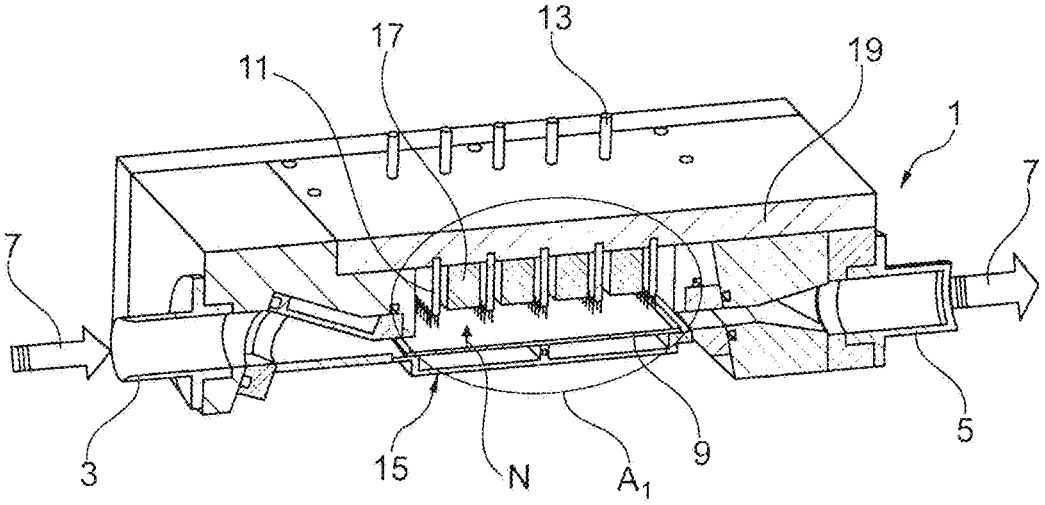
Fig. 1 (Prior Art)
FIG. 1 illustrates the basic structure of such a device. Therein.

The separator device 1 has an inlet line 3 and an outlet line 5. In particular, a gas flow 7—such as a blow-by gas flow—is introduced into the separator device 1 through the inlet line 3. The gas flow 7 contains, in particular, contaminants, such as solid and liquid particles, in particular, oil particles. A first electrode in the form of a counter electrode 9 and a plurality of second electrodes in the form of emitter electrodes 11 are arranged within the separator device 1.

The gas flow 7 is guided through the separator device 1 substantially perpendicularly to a normal direction N of the counter electrode 9. A direct-current voltage that is higher than a breakdown voltage, in particular, corresponds to at least 1.2 times the breakdown voltage is applied to the emitter electrodes 11 by means of electrical terminals 13. The direct-current voltage applied in this manner causes a low-energy plasma to be ignited or constituted between the emitter electrodes 11 and the counter electrode 9. A current applied to the terminals 13 is adapted, in particular, in accordance with the flow rate of the gas flow 7 through the separator device 1, but also in accordance with other parameters.

The plasma constituted between the emitter electrode 11 and the counter electrode 9 causes a portion of the contaminants in the gas flow 7 to be accelerated in the direction of the counter electrode 9. The contaminants, which are then collected in the region of the counter electrode 9, are led to a collecting space 15 and led from there to a discharge line (not shown).

In order to prevent the gas flow 7—and, therewith, the contaminants contained therein—from entering a region between the emitter electrodes 11, it is provided that partition elements 17 are provided in an intermediate space between the emitter electrodes 11. Both the partition elements 17 and the emitter electrodes 11 are at least indirectly fastened onto a support element 19 that comprises, in particular, an insulating and/or ceramic material. The emitter electrodes 11 are fastened indirectly via a thermoset body 21 on which high-ohmic resistors, by means of which the emitter electrodes 11 are connected to the terminals 13, are arranged.

The device described in DE 10 2011 053 578 A1 has fundamentally proven to be a success. It has, however, been shown that the long-term stability and quality of the low-energy plasma generated in the device can be improved. Thus, in particular, it has been shown that in an adjacent region to the plasma or plasma cone that forms, there occurs an ion wind that causes the contaminants to be accelerated partially in the direction of the emitter electrode or the support element. These particles—in particular, oil drops—can then settle in the region of the support element or the thermoset body 21. Once there, they may agglomerate and, due to the force of gravity, flow along the thermoset body or emitter electrodes to the end of the emitter electrode that faces the counter electrode. Under unfavorable conditions, this may cause the particles to flow in the end region of the emitter electrode that faces the counter electrode—the plasma being produced in this region—and char there due to the prevailing temperature there, thus accumulating on the electrode end. This, in turn, may lead to a change in the resistance, to a lowering of the resistance if the deposit is conductive and to an increase in the resistance if the deposit is insulating, so that a stable low-energy plasma then is not formed at the corresponding electrode.

The present invention therefore addresses the problem of further developing the generic device so as to overcome the disadvantages of the prior art, in particular, to achieve an improvement in the durability of the separator device. There should also be provided an improved method for operating a generic device that also overcomes the disadvantages known from the prior art.

This problem is solved according to a first alternative in that the second electrode extends substantially along a first axis in a first direction, and the first electrode has at least one plateau region which is arranged opposite the second electrode and which extends at least regionally in a first plane running substantially perpendicular to the first direction.

Therein, especially preferably, the plateau region is arranged coaxially to the second electrode, and/or the flow path runs substantially between the second electrode and the plateau region.

The present invention also proposes that the plateau region have, at least regionally, in particular, in the edge region, a surface that is curved in the direction of the second electrode and/or against the first direction.

Furthermore, the present invention provides that the plateau region be arranged spaced apart from a base level of the first electrode in the direction of the second electrode.

In special embodiments, preferably, a plurality of second electrodes are present, and the first electrode has a plurality of plateau regions, wherein each of the second electrodes is associated with a respective plateau region.

A device according to the present invention may also be characterized in that the plateau region is connected to the base level by means of a spacer element (in particular, an electrically conductive one) extending against the first direction.

In the aforementioned embodiment, it is especially preferable that the spacer element run coaxially to the first axis or the spacer element run spaced apart from the first axis, preferably at least regionally parallel to the first axis, and the plateau region be connected to the spacer element by means of at least one connecting element that preferably runs substantially perpendicularly to the first direction and/or along the first plane.

The present invention also proposes that the first electrode have at least regionally a substantially C-shaped cross-section, in particular, the C-shape being formed of the base level, the spacer element, the connecting element, and the plateau region.

In the aforementioned embodiments, it is especially preferable that the plateau region, the spacer element, the base level, and/or the connecting element be configured at least regionally as a single piece.

Further preferably, the plateau regions are connected by means of at least one connecting device that extends substantially parallel to the base level and/or has a lesser extension in at least one direction of the first plane than the plateau regions.

In the aforementioned embodiment, it is especially preferable that the plateau regions be arranged along a straight line in a direction perpendicular to the first axis, in particular, that the connecting devices extend substantially along the straight line and/or a network and/or matrix be configured by means of the connecting devices, wherein at least one plateau region is arranged on at least one of the points of intersection of the connecting devices, wherein the network and/or matrix extends along the first plane.

Further preferably, the plurality of plateau regions are provided by at least one counter electrode element that is preferably configured at least regionally as a punched sheet metal part.

In the aforementioned embodiment, it is especially preferable that the plateau regions be arranged in the counter electrode element along a second direction and/or at least two counter electrode elements can be arranged with mirror symmetry relative to one another, preferably at least regionally interlocking with one another, preferably offset from one another in such a manner that the plateau regions of the respective counter electrode elements are arranged offset relative to one another along the respective second direction.

It is also proposed as an alternative for the aforementioned embodiment that the plateau regions and connecting elements be formed of the punched sheet metal part.

In another alternative, complementary to the aforementioned features of a first alternative or alternatively thereto, a device may be characterized by at least one drip element which is operatively connected to the second electrode and by means of which fluid particles of the gas flow that are moving in the direction of and/or along the second electrode can be collected in such a manner that the fluid particles come loose from the drip element at a distance from the electrode end.

In this embodiment, it is especially preferred that the drip element be at least regionally encompassed by at least one approach flow element arranged in the region of the second element.

It is furthermore proposed that the second electrode encompass at least regionally the drip element, wherein, by means of the drip element, fluid particles flowing along the second electrode in the direction of the electrode end can be collected at a distance from the electrode end in such a manner that the fluid particles come free from the second electrode at a distance from the electrode end.

In the aforementioned embodiment, it is especially preferred that the electrode end and an infeed end of the second electrode that is opposite the electrode end be arranged offset from one another along a first axis extending in a first direction in such a manner that the electrode end is arranged close to the first electrode, and that the drip element be formed at least regionally by a transition region of the second electrode that is arranged between a first electrode region—in which at least one surface region of the second electrode and/or the electrode extends from the infeed end in the direction of the electrode end in a direction with a direction component along the first axis—and a second electrode region in which at least one surface region of the second electrode and/or the second electrode extends at least regionally in a direction with a direction component against the first direction.

The present invention also proposes that at least one surface region of the second electrode and/or the second electrode extend from the infeed end in the direction of the electrode end, in particular, subsequently to the second electrode region, in a third electrode region in a direction with a direction component along the first axis, preferably in such a manner that the drip element is arranged along the first axis above the electrode end.

One embodiment according to the present invention may also be characterized in that the drip element is encompassed by and/or constituted of at least one winding of the second electrode, at least one kink of the second electrode and/or the approach flow element, at least one helical region of the second electrode, at least one protuberance of the surface of the second electrode and/or the approach flow element, at least one skirt, and/or at least one disc element.

The present invention proposes that the drip element circumferentially surround the second electrode, preferably radially symmetrically, that the drip element be arranged downstream of the gas flow, and/or that the approach flow element be arranged upstream of the gas flow.

A device according to the present invention may also be characterized in that the drip element is configured at least regionally as a single piece with the second electrode and/or the approach flow element.

In a third alternative, in addition and/or as an alternative to the aforementioned mentions, it may be provided that the second electrode has at least one taper, in particular, in the region of the electrode end.

With the aforementioned embodiment, it is especially preferable that the taper be configured in the form at least one tip, at least one ridge, and/or at least one edge.

The present invention also proposes that the second electrode have a substantially cylindrical, triangular, quadratic, rectangular, and/or polygonal cross-sectional shape in a plane perpendicular to a main extension direction, in particular, the first direction, that the second electrode have an end surface inclined with respect to the main extension direction, in particular, in the region of the electrode end, and that, in particular, the taper be encompassed by an edge of the end surface.

It is also preferred that the second electrode have—in particular, in the region of the electrode end—at least regionally a hollow region in which the second electrode is configured so as to be hollow, in particular, in the shape of a hollow cylinder, tube, and/or a cone shell, wherein preferably the taper is encompassed by at least one end edge of the wall of the hollow region, in particular, the taper is circumferential on the electrode end.

A device according to the present invention according to the third alternative may also be characterized in that: the second electrode comprises a carbon material, at least regionally, in particular, in the region of the electrode end; and/or the second electrode comprises at least one coating—preferably one that reduces the attachment of particles and/or fluid, in particular, a coating comprising titanium nitride, nanosol, at least one nanoparticle-containing material, at least one material constituting a surface having a nanostructure, and/or chromium nitride—at least regionally, in particular, in the region of the electrode end In a fourth alternative, as an alternative to or in addition to the measures of the aforementioned three alternatives, it may be provided that at least one partition element that is substantially impermeable to the gas flow and/or the contaminants and is electrically and/or electrostatically permittive is arranged at least regionally between the flow path and the first electrode and/or the flow path and the second electrode.

Therein, it is especially preferred that the partition element comprise at least one partition film and/or partition membrane and/or comprise polytetrafluoroethylene at least regionally.

The present invention also proposes that the partition element touch the second electrode, in particular, the electrode end, or the first electrode.

Especially preferably, a device according to the present invention according to the fourth alternative is characterized in that at least one discharge opening is provided in the partition element when the partition element is arranged between the first electrode and the flow path, wherein contaminants that have been separated off from the gas flow—in particular, those that collect on the side of the partition element that faces the gas flow—can be discharged by means of the discharge opening into at least one collecting space. According to a fifth alternative that may be configured in addition to or as an alternative to the aforementioned four alternatives, a device according to the present invention may be characterized in that the device comprises at least two second electrodes, preferably a multitude of second electrodes, wherein the second electrodes extend out from at least one first support element, and at least one drain device is provided in order to reduce an electrostatic charge of the support element and/or to discharge charge carriers collecting on a surface of the support element, at least in the region between the second electrodes.

Therein, it is especially preferred that the second electrodes pass at least regionally through the support element and/or that the support element comprise at least one ceramic element.

In the two aforementioned embodiments, it is proposed that the drain device comprise at least one drainage element that is at least regionally installed on the support element and/or at least regionally embedded in the support element, wherein the drainage element preferably comprises at least one drain coating (in particular, an electrically conductive one), at least one drain fabric (in particular, a polyamide-containing and/or grounded one), and/or at least one metal band such as a copper band, and/or the drain device is configured as a conductive tunnel element.

It is also preferred that the drain device comprise at least one depression at least regionally configured in the support element.

In the aforementioned embodiments, it is especially preferred that the drain device comprise at least one drainage device arranged in the region between the electrode ends of the second electrodes and the support element.

In the aforementioned embodiments, it may be provided that the drainage device comprises at least one conductive mesh, at least one conductive foam, at least one shield element that surrounds the respective second electrode at least regionally and preferably is curved radially outward in the direction of the electrode end, wherein, in particular, the drainage device is at the same electrostatic potential as the second electrodes.

Furthermore, the present invention finally proposes for the device according to the present invention that the drain device, the drainage element, the drain coating, and/or the drainage device stretch at least regionally along and/or in a first wall and/or second wall that extend(s) at least regionally in a direction between the second electrode and the first electrode in a direction along the first axis and/or in the first direction and/or opens into the at least one inlet opening or an outlet opening, and/or along and/or in a third wall that extends at least regionally in parallel to the first support element, at least regionally below the first electrode, and/or at least regionally on the side of the first electrode that faces away from the second electrode.

According to a sixth alternative that may be configured in addition to or as an alternative to the aforementioned five alternatives, a device according to the present invention may be characterized in that the device comprises at least two second electrodes, preferably a multitude of second electrodes, and at least one influencing device for influencing the electrical field formed by the at least two second electrodes can be and/or is arranged at least regionally between the at least two second electrodes.

Then, it is especially preferred that the influencing device can be and/or is arranged substantially at least regionally opposite at least one first electrode, preferably a plurality of first electrodes, and/or a (preferably predetermined) electric potential can be or is applied.

In the aforementioned embodiment, it may be provided that the influencing device can be and/or is conductively connected to the at least one first electrode, the potential of the first electrode can be and/or is applied to the influencing device, and/or the influencing device and the drain device, the drainage device, and/or the drainage element are at least regionally configured together.

The present invention also provides a method for operating a generic device or a device according to the present invention, wherein a liquid and/or particulate contaminant-containing gas flow is supplied to the device, the gas flow is guided at least partially along a flow path configured between at least one first electrode and at least one second electrode in order to separate the contaminants off from the gas flow, and a direct-current voltage in excess of the breakdown voltage is configured between the first electrode and the second electrode in order to form a stable low-energy plasma, the method further comprising a cleaning step for cleaning the first electrode and/or second electrode.

For the method, it is proposed, in particular, that during the cleaning step, a ground potential is applied to at least a first group of a plurality of second electrodes, or a voltage that exceeds the direct-current voltage and produces a breakdown between the first electrode and the second electrodes of the first group is applied, in particular, while the direct-voltage for forming the low-energy plasma is applied to at least one second group of the second electrodes.

In the aforementioned embodiment, it is especially preferred that the second electrodes be associated alternately with the first group and the second group.

It is furthermore proposed for the method that, in the cleaning step, a mechanical excitation of the first electrode and/or the second electrode is produced, preferably by means of an ultrasonic vibration produced by at least one excitation device, wherein preferably at least one piezoelectric element and/or at least one component of an internal combustion engine and/or a vibration transfer device operatively connected to a component of the internal combustion engine in order to transfer vibrations is/are used as the excitation device.

Finally, a method according to the present invention may be characterized in that the cleaning step comprises the sequential departure of at least two first electrodes and/or two second electrodes by means of a cleaning element such as at least one brush.

According to a first alternative or a first solution, thus, the aforementioned problem regarding the device is solved in that the second electrode extends substantially along a first axis in a first direction, and the first electrode has at least one plateau region which is arranged opposite the second electrode and which extends at least regionally in a first plane running substantially perpendicular to the first direction.

Another proposal as a second solution in order to solve the problem according to the present invention—as an alternative to or in addition to the first solution—is at least one drip element which is operatively connected to the second electrode and by means of which fluid particles of the gas flow that are moving in the direction of and/or along the second electrode can be collected in such a manner that the fluid particles come loose from the drip element at a distance from the electrode end.

For the device according to the present invention, it is proposed—in order to solve the problem according to the present invention in a third solution that may be implemented as an alternative to or in addition to the first solution and/or the second solution—that the second electrode have at least one taper, in particular, in the region of the electrode end.

According to a fourth solution, the present invention proposes that in order to achieve the desired effects as an alternative to or in addition to the three aforementioned solutions, the configuration is such that at least one partition element that is substantially impermeable to the gas flow and/or the contaminants and is electrically and/or electrostatically permittive is arranged at least regionally between the flow path and the first electrode and/or the flow path and the second electrode. Therein, a partition element is understood to be, in particular, a partition element—such as a partition film and/or partition membrane—that is basically closed and/or at least partially permeable for electrodes. Finally, as a fifth solution for solving the problem according to the present invention for the device according to the present invention, it is proposed that the device comprise at least two second electrodes, preferably a multitude of second electrodes, wherein the second electrodes extend out from at least one first support element, and at least one drain device is provided in order to reduce an electrostatic charge of the support element, at least in the region between the second electrodes, wherein the fifth solution may be implemented as an alternative to or in addition to the four previously-mentioned solutions.

It is furthermore proposed that the drain device also may extend into other (wall) regions, in particular, into a first and/or second wall and/or a third or bottom wall. In this manner, it is possible to form a "Faraday cage." The drain device is preferably electrically conductive, at least at the surface thereof and/or entirely.

A proposal as a sixth solution in order to solve the problem according to the present invention—as an alternative to or in addition to the five preceding solutions solution—is that the device comprise at least two second electrodes, preferably a multitude of second electrodes, and at least one influencing device for influencing the electrical field formed by the at least two second electrodes is provided at least regionally between the at least two second electrodes. Therein, an influencing device is understood to mean, in particular, metal sheets or solid bodies made of metal.

Finally, the present invention provides a method for operating a device according to the present invention or a generic device, wherein a liquid and/or particulate contaminant-containing gas flow is supplied to the device, the gas flow is guided at least partially along a flow path configured between at least one first electrode and at least one second electrode in order to separate the contaminants off from the gas flow, and a direct-current voltage in excess of the breakdown voltage is configured between the first electrode and the second electrode in order to form a stable low-energy plasma, the method further comprising a cleaning step for cleaning the first electrode and/or second electrode.

The present invention is thus based on the surprising finding that a relatively simple construction-related or structural adaptations to the generic device make it possible to significantly increase the long-term stability thereof. This allows for the device also to be used, for example, to remove oil residue from fresh air that is supplied to a passenger cabin of an aircraft and, for example, has been taken from a turbine. Thus, the device makes it possible to effectively avoid aerotoxic syndrome.

According to a first solution, it is proposed that a special configuration of the counter electrode be selected. In contrast to the counter electrode known from the prior art, in which a substantially flat counter electrode has been proposed, the first solution provides that a separate counter region of the counter electrode be associated with each individual emitter electrode. This region of the counter electrode, called a plateau region, is spaced apart from a base level of the counter electrode, in particular, by a spacer element. The plateau regions projects forth from the base level in the form of "mushroom elements," so to speak. Therein, it may be provided that the spacer element is arranged coaxially to the emitter electrode, or a longitudinal axis of the spacer element extends at least regionally in displacement of the direction of extension, in particular, the first direction and/or along the first axis. This construction of the counter electrode causes particles—in particular, oil drops—collecting on the counter electrode to flow off independently from the plateau region, in order to then be able to flow off over the base level into the collecting space.

The off-flow of the particles is particularly supported by when the plateau region has a curvature at least regionally. Then, the curvature may be configured solely in an edge region of the otherwise flat plateau region. Thus, a compromise is achieved between the best possible configuration of a (wide) plasma cone through the flat region and the best possible discharge of particles. The curvature causes particles arranged in the flat plateau region to also be "entrained"—in particular, due to the viscosity of a contaminant fluid—when particles flow off from the edge region. There is thus an advantage achieved in that accumulation of particles in the region of the counter electrode where the plasma forms is prevented. It was thus recognized that accumulation in this region may lead to an unwanted charring of the particles and thus to disturbance of the plasma.

In order to make it easier to provide the plateau regions of the counter electrode, an especially preferred embodiment proposes that a plurality of plateau regions are composed of a single counter electrode element. This counter electrode element is preferably configured as a punched sheet metal part and has a C-shaped or a "reclining" U-shaped cross-section. The lower cross-member of the counter electrode element forms the base level from which the spacer element extends substantially perpendicularly upward. A spoon-shaped element—constituting a connecting element that, so to speak, forms the "stem" of the spoon, and the plateau region, that forms the "scoop region" of the spoon—then protrudes perpendicularly to the spacer element The connecting element produces an electrical connection between the spacer element and the plateau region, and simultaneously retains the plateau region mechanically. This makes it possible for a plurality of plateau regions that are arranged next to one another in a second direction to be configured on the spacer element. In particular, if two of these counter electrode elements have been arranged with mirror symmetry to one another and have been arranged offset in the second direction, then it is thus possible to provide, in the region of the counter electrodes, a plurality of plateau regions offset to one another. Then, the counter electrode elements may be configured with complete mirror symmetry. Alternatively—in particular, when the base levels are arranged so as to overlap at least regionally—the counter electrode elements may differ in the length of the spacer elements in such a manner that the plateau regions of the counter electrodes are arranged at the same height or at the same distance to the second electrodes.

Another embodiment may provide that the plateau regions are connected to one another by connecting devices. Then, the connecting devices have a smaller extent than the plateau regions in a first plane, at least in one direction. In this manner, it is possible to provide a chain or a matrix or network of plateau regions that are arranged above a base level. It is thus possible to forgo spacer elements for each individual plateau region, in particular, the plateau regions and the connecting devices are "stretched" over the base level at the respective endpoints. Omitting the spacer element enables a better off-flow of the contaminants under the plateau regions, because a substantially open space can be provided below the plateau regions.

The use of these counter electrode elements makes it possible to associate the respective plateau region with each emitter electrode so that a plasma cone can be formed in the region of each emitter electrode, at a predetermined place and in a predetermined region, the plasma cones furthermore being formed at a fixed relative position to one another due to the relative arrangement of the individual plateau regions. The plasma cones are moreover stabilized due to the improved off-flow of the particles from the plateau region, in particular, due to the curvature, at least in the edge region. Thus, the particles face no barriers when flowing off of each of the plateau regions, so that agglomeration of particles—such as may occur with counter electrodes known from the prior art—can be prevented.

A second solution, which may be implemented as an alternative to or in addition to the first solution described above, proposes that a drip element be configured in the region of the emitter electrode. This drip element may, in particular, be configured integrally with the emitter electrode, or may be implemented as a separate component that is arranged independently of the emitter electrode or is connected thereto.

The use of such a drip element is based on the finding that in the region of the plasma cone—in particular, adjacent to or even in the plasma cone—there occurs an ion wind that causes contaminants of the gas flow that have been loaded due to passage through previous plasma regions to be accelerated in a direction toward the emitter electrode. This allows contaminants—in particular, fluid droplets—to accumulate in the region of the support element or thermoset body above the plasma cone. The contaminants are basically harmless in these places. The arrangement of the emitter electrodes on the support element may also be due to the emitter electrodes going through a support element in the form of a perforated plate, respectively through the holes of the perforated plate, and the electrode tips protruding out therefrom. The support element may also comprise other or additional materials, as or in addition to a thermoset, such as a ceramic material.

However, in order to prevent deposits that are conductive, such as condensate, water, or soot particles, from being able to collect in this region, thermally insulating materials are preferably used as wall materials. This, in particular, lowers the tendency for condensate liquid to collect on the surface of the housing after times where the separator is allowed to stand.

However, over a longer period of operation of the separator device, it may occur that contaminants agglomerate and then move in the direction of the counter electrode due to the effects of gravity. This happens mostly such that the fluid drops run down the thermoset body or the perforated plate and then flow along the emitter electrode in the direction of the electrode tip or electrode end.

The drip element according to the present invention causes agglomerating fluid drops to flow at a distance from the electrode tip in the direction of the counter electrode, and drain outside of the emitter electrode in the direction of the counter electrode or be swept back by the gas flow.

As has previously been described, it may be provided that the emitter electrodes have such a winding that a first region of the emitter electrode extends first in the direction of the counter electrode, but a second region adjoins same, in which second region the emitter electrode extends away from the counter electrode in order to then extend in a third direction back in the direction of the counter electrode to then open into the electrode tip or in the electrode end.

This causes liquid particles flowing down the emitter electrode to first gather in the deepest point in the winding and yet be unable to flow to the electrode tip. If the amount of fluid gathering in the deepest point of the winding reaches a predetermined level, the liquid comes loose from the drip element without reaching the electrode tip, in particular, without being to cause charring of the electrode tip while there.

Corresponding drip elements may also be configured as shield-shaped elements that surround the emitter electrode in a bell-shaped manner in order to form corresponding drip elements at the outer edge of the shield. It may also be provided that the emitter electrode has corresponding bulges, preferably configured integrally with the electrode material, at the surface thereof.

An alternative embodiment or a third solution may provide that the drip element is configured by configuring the emitter electrode so as to be regionally hollow, in particular, in the region of the electrode end. This causes a substantially circular drip element to be configured at the electrode end, if the electrode has a substantially cylindrical cross-section.

This structure—if a liquid droplet reaches the electrode end—causes the plasma generation to suspend in this region, so that another region of the cylindrical drip element acts as a point of origin for the plasma. This prevents fluid droplets sticking to the drip element from being heated by the plasma in such a manner as to cause charring of the electrode tip. If the liquid droplets come loose due to gravity, the point of origin of the plasma cone wanders to a corresponding place along the circular drip element. Thus, overheating and charring of the electrode tips is also effectively prevented.

A fourth solution, which may be implemented in addition to or as an alternative to one or more of the previously described solutions, proposes that the flow region of the flow be hermetically isolated from the regions in which the emitter electrode/counter electrode is arranged. In particular, it is proposed that this partitioning be carried out between the flow region and the emitter electrode.

For this purpose, it is proposed that the flow path—in particular, in the region of the emitter electrode—be delimited by a partition element such as a film or membrane that is impermeable to the gas flow or particles contained therein, i.e., in particular, the blow-by gas, in the region of the emitter electrode. The partition element is, however, impermeable to charge carriers such as electrons. Examples of suitable elements include, in particular, Teflon or polytetrafluoroethylene films that have been produced. These offer an advantage in being electrically permittive, i.e., that the direct-current voltage applied to the emitter electrode can pass through the film into the flow region so that the low-energy plasma continues to form in the flow region. In other words, electrodes can pass through the partition element. It is especially preferred that the film be in direct contact with the electrode tips of the emitter electrodes. In this manner, the best possible configuration of the low-energy plasma may be ensured, alongside simultaneously the best possible separation of the electrode region from the gas flow. In particular, particles located in the gas flow—which as previously described, may lead to contamination and charring of the electrodes—are thus prevented from being able to gather on the emitter electrode or adjacent structural elements of the separator device.

If a corresponding partition element is provided in the region of the counter electrode, then it is proposed, in particular, that the partition have corresponding discharge openings through which the contaminants can flow to predetermined places in a corresponding collecting space.

A fifth solution that may be implemented as an alternative to or in addition to one or more of the four aforementioned solutions proposes that additional measures be taken to reduce acceleration of particles from the gas flow in the direction of the emitter electrodes or regions adjacent thereto.

It has thus been recognized, in particular, that the partition walls known from the prior art bring about the possibility of electrostatic charging of the surface in an intermediate region between the emitter electrodes, which charging then causes contaminants that have been ionized by previous plasma cones to be accelerated in the direction of this electrostatically charged surface, to be agglomerated there and then wander along the emitter electrode in the direction of the counter electrode.

Already, the omission of the corresponding partition walls leads to an improvement of the situation. The present invention also proposes, however, that corresponding drain devices be provided in an intermediate region between the emitter electrodes or emitter electrode rows. In the simplest embodiment, a corresponding drain device is constituted of a depression, in particular, one that is configured in the support element. The corresponding spacing apart of the sunken regions of the depression from the emitter electrode bring about a reduced electrostatic charging of the surface region of the support element. Moreover, the present invention proposes that active drainage elements be arranged in the region of the surface regions arranged between the emitter electrodes.

The drainage elements may, in particular, be an electrically conductive coating that causes charge carriers collecting in the region of the surface to be removed as quickly as possible. The drain coating may be applied to the corresponding surface, or may be provided in the surface of embedded elements, such as a conductive fabric, that contain, in particular, polyamide or a metallic material such as copper. In particular in the case where the drain coating or the drain fabric is placed at the same electrical potential as the emitter electrode, attraction of contaminants that have been ionized in the gas flow is prevented.

In particular, if the drainage element extends through the walls that surround the region between the emitter electrode and the counter electrode, a space that acts as a Faraday cage can be formed. If the drainage element is connected to ground, surface charges of the walls can flow directly off and thus electrostatic attraction forces on the contaminants—which could cause there to be deposits on the walls—can be effectively avoided.

The configuration of tunnel-shaped drainage elements leads, in particular, to an increase in the size of the counter electrode surface. These tunnel elements are preferably each arranged alternately with the electrodes.

As an alternative or in addition, the tunnel elements may furthermore comprise a very coarse conductive mesh or conductive grid bars/threads that serve to improve the discharge of contaminants to the additional counter electrodes (tunnel surface).

It may also be provided that another drainage device is arranged at a distance from the surface. This may be implemented, for example, by a mesh that is electrically conductive, wherein the emitter electrodes pass through the drainage device. If the drainage device is placed at the same electrical potential as the emitter electrodes or connected to ground, then an effect attracting particles present in the gas flow can also be prevented. The drainage of the electrostatic charge on the corresponding surface prevents overall contaminants from being able to collect and agglomerate in the surface region, which could otherwise cause the contaminants to gather on the emitter electrode and, while there, lead to crusting or burning of contaminants.

A corresponding drainage device may also be implemented through a shield element that surrounds the emitter electrode and may simultaneously also serve as a drip element.

Finally, in a sixth solution that may be implemented as an alternative to or in addition to one or more of the five aforementioned solutions, it is proposed that static influencing of the electric field by means of at least one influencing device directs the ion winds, due to the modified field shape, in particular, of the plasma cone, so as to no longer adversely affect the blow-by, namely, such that adverse turbulence of the blow-by no longer occurs. The modification also brings about early separation of the particles, so that the particles are no longer entrained so far in the blow-by.

It has thus been recognized, in the device known from the prior art and through experiments, that the flow behavior of the blow-by due to turbulence in the region of the emitter electrodes causes particles to reach the emitter electrode tips, i.e., to be able to lead to contamination. It has furthermore been recognized that when the previously described influencing device—in particular, the tunnel-shaped configuration, which may constitute a conductive device in the form of a frame element—is properly designed, then this influences the electric field formed by the emitter and counter electrode in such a manner that due to the new field, the ion winds direct blow-by preferably downward in the direction of the counter electrode. Thus, the ion winds no longer have an adverse in that particles of the blow-by are no longer transported in the direction of the emitter electrodes. In association therewith, it has been observed that detrimental turbulence of the blow-by is no longer present, or at least can be reduced. An especially compact and simple design results when at least one influencing device is configured at least regionally in one with at least one drain device and/or at least one drainage element.

Then, the influencing device is preferably a metallic insert that is connected to the counter electrode and thus grounded, or in any case is at the same potential as the counter electrode. The influencing devices cause a frame located at a defined potential to be configured around the blow-by flow. The counter electrode surface is also increased in size when the influencing device is placed at the potential of the counter electrode. The shape of the influencing device, in particular, a cross-sectional shape in a plane perpendicular to the flow device may be selected, in particular, with a substantially C-shaped cross-sectional profile that is preferably composed of three partial segments that are preferably arranged perpendicular to one another, and/or preferably of a substantially perpendicular arrangement of the segments with an arc-shaped connection between the respective partial segments. The influencing element may also be constructed in the form of at least one continuous arc. The influencing device then extends, in particular, at least regionally between at least two second electrodes along the upper wall, and continuing downward along the two side walls.

It has then been shown that the end faces of the influencing device, i.e., the sides facing the emitter electrodes lead to displacement of the electric field and it is consequently possible, in particular, to configure the influencing devices either out of a metallic solid body or out of a sheet. It is also sufficient if a conductive surface is configured only on the end face. For example, thus, a main body may be non-conductive, only a coating or a conductive region being present on the end face. It has also been shown that the positive effect of the influencing device on the behavior of the blow-by can, through continuous repetition of influencing devices along the direction of flow of the blow-by, in particular in alternation with groups of second electrodes, also be transmitted to subsequent emitter electrodes along the direction of flow of the blow-by. This makes it possible for all of the electrode tips to be protected to the greatest extent possible from contamination due to deposited particles.

Finally, the present invention proposes a method for operating a device according to the present invention that overcomes the aforementioned drawbacks of the prior art.

In particular, it is proposed that a cleaning step be carried out during the operation of the separator device. This cleaning may be performed in a variety of ways. Thus, on the one hand, a group of emitter electrodes, in particular, an entire emitter electrode row can be cleaned during operation by electrically grounding emitter electrodes. This causes contaminants that have been deposited on the emitter electrode to be entrained by the gas flow or drawn to the counter electrode due to a capacitor effect. It is also conceivable for the first group of emitter electrodes to be provided with a voltage that produces a breakdown between this emitter electrode and the counter electrode. This leads to burning free of the emitter electrode, i.e., burning off of the contaminants arranged on the emitter electrode. In particular, it is further preferred for the individual emitter electrodes to be alternately subjected to this cleaning step, in particular, for the emitter electrodes to be successively each grounded or provided with the free-burning voltage.

As an alternative or in addition, it may be provided that a mechanical cleaning of the emitter electrodes is carried out. For this purpose, it is proposed that the emitter electrodes be made to vibrate, in particular, made to vibrate ultrasonically. This may be performed by producing an ultrasonic vibration through a piezoelectric element, or by mechanically connecting the electrodes to a vibrating element, in particular, a component of an internal combustion engine, and thus, through the stimulating vibration, achieving a cleaning by loosening the contamination on the emitter electrode.

As an alternative or in addition, cleaning may be performed through a cleaning element, such as a brush, that is guided sequentially over the electrode tips.

Other features and advantages of the present invention arise from the following description, which describes preferred embodiments of the present invention with reference to schematic drawings.

Figure 2:
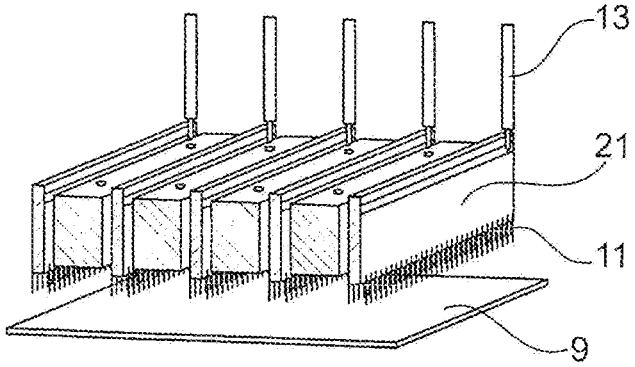
Fig. 2 (Prior Art)
FIG. 2 depicts a schematic cross-sectional view of the section A1 of FIG. 1.
Figure 3A:
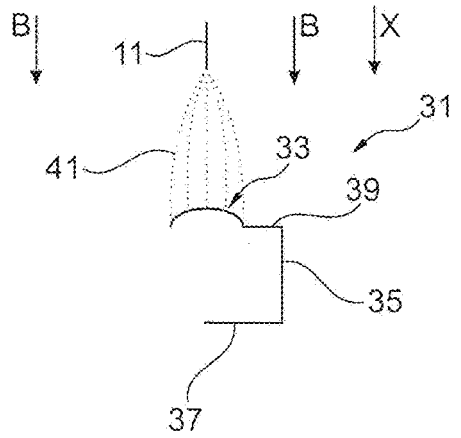
Figure 3B:
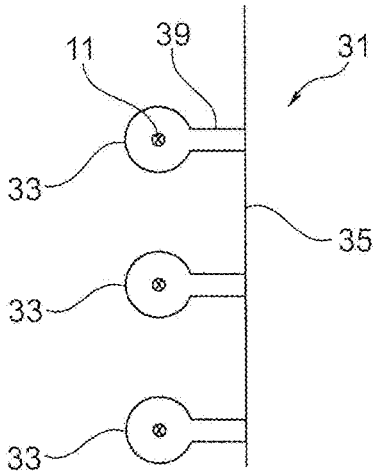
Figure 4A:
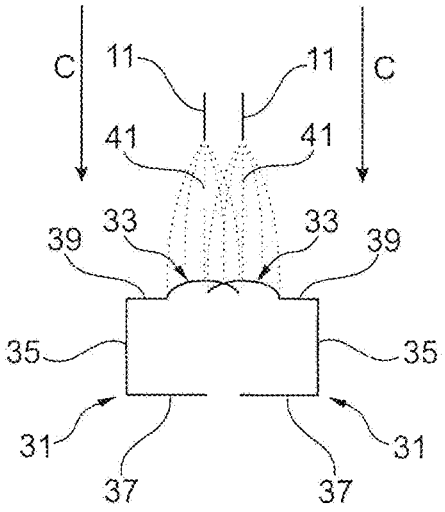
Figure 4B:
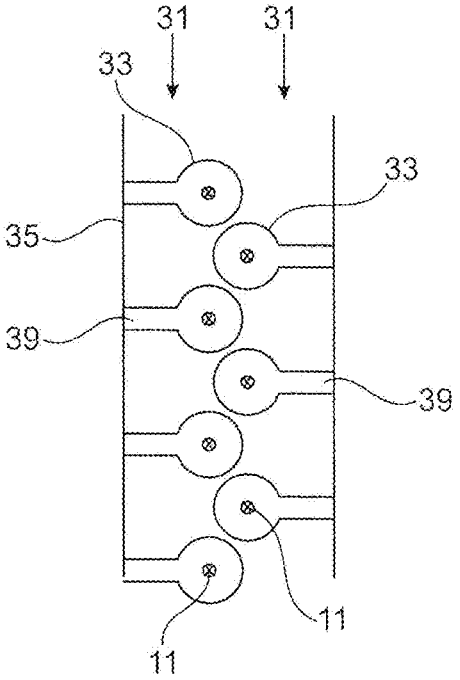
Figure 4C:
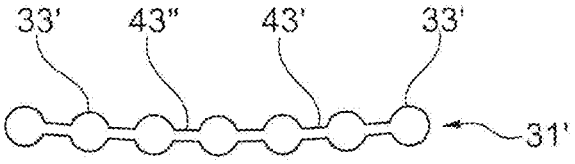
Figure 4D:
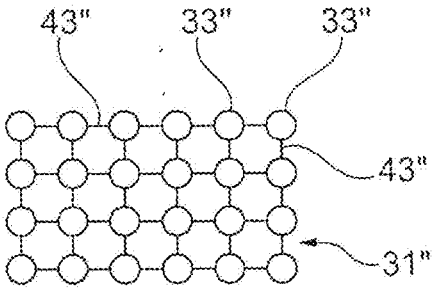
Figure 6A:
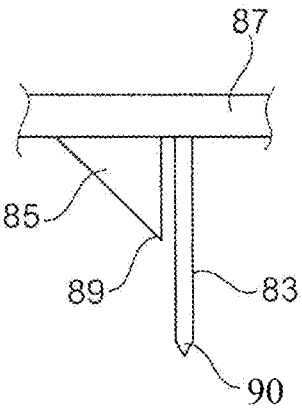
Figure 7:
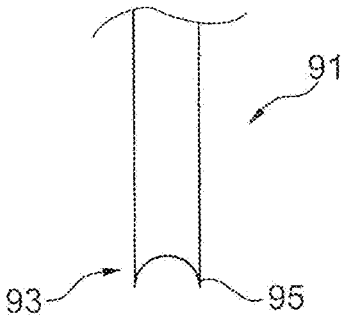
Figure 8:
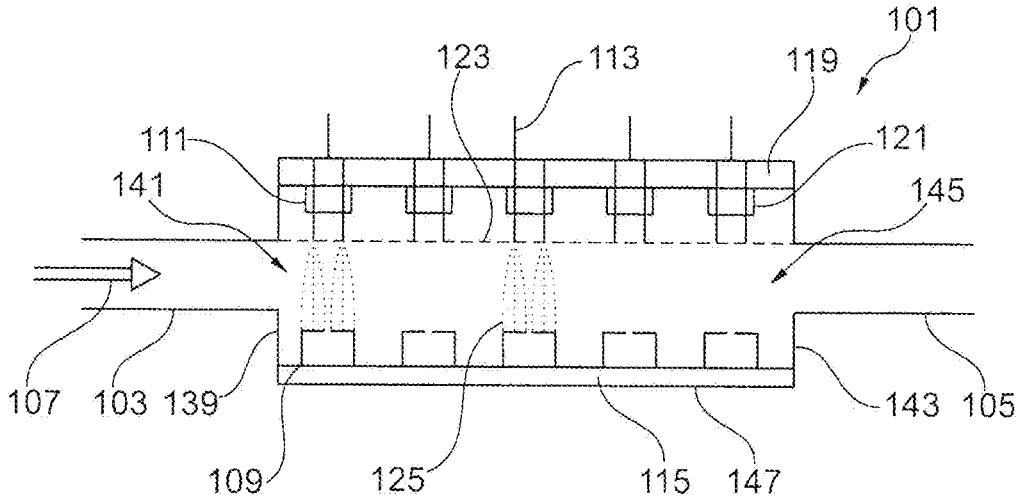
Figure 9:
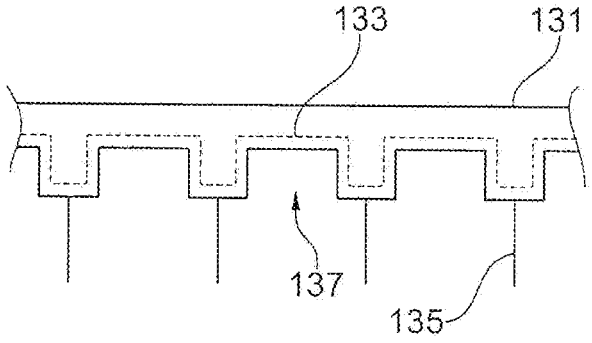
Figure 10:
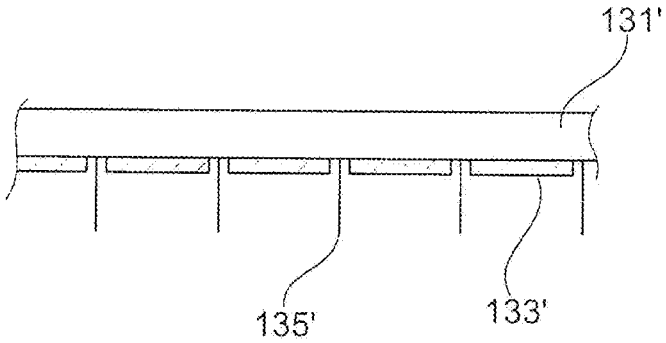
Figure 11:
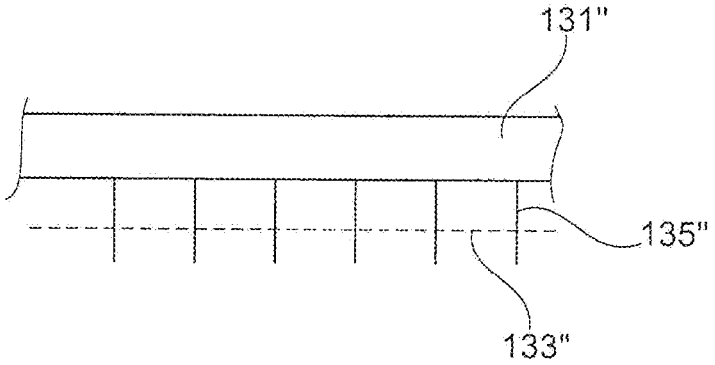
Figure 12:
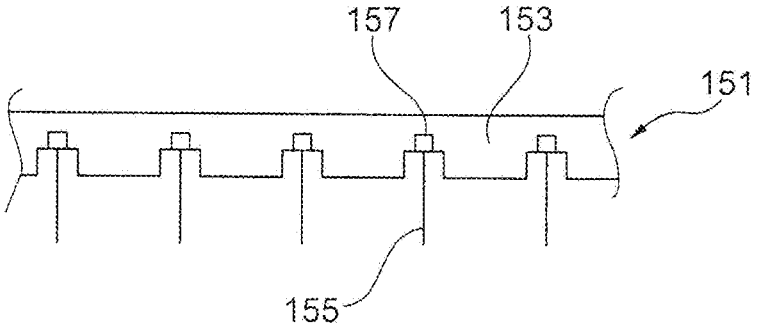
Figure 13:
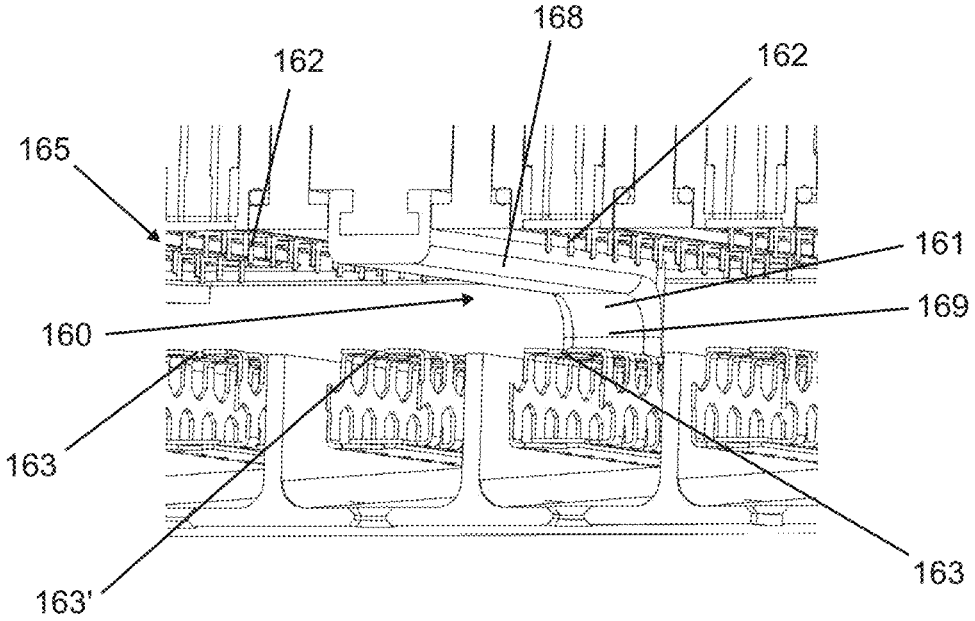
Figure 14:
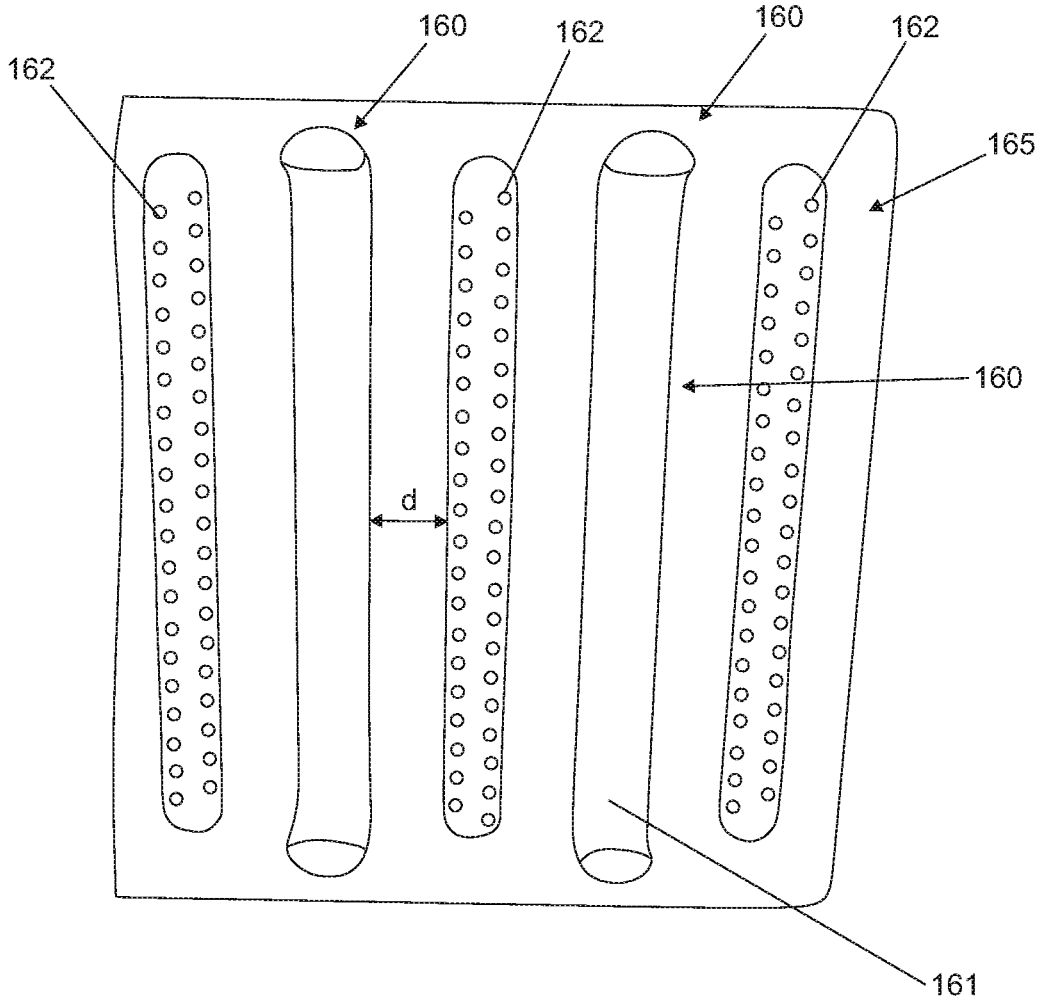
Figure 15A:
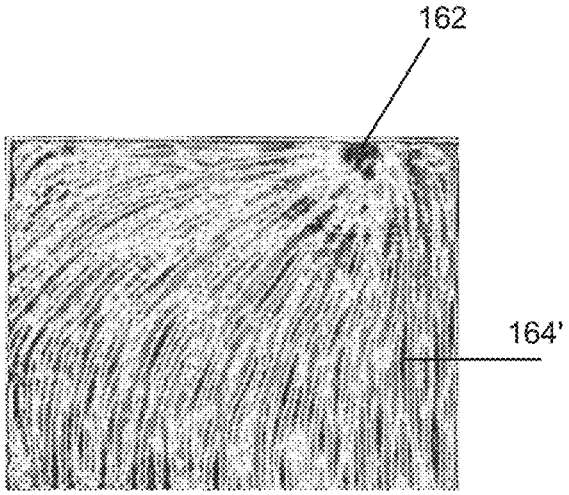
Figure 15B:
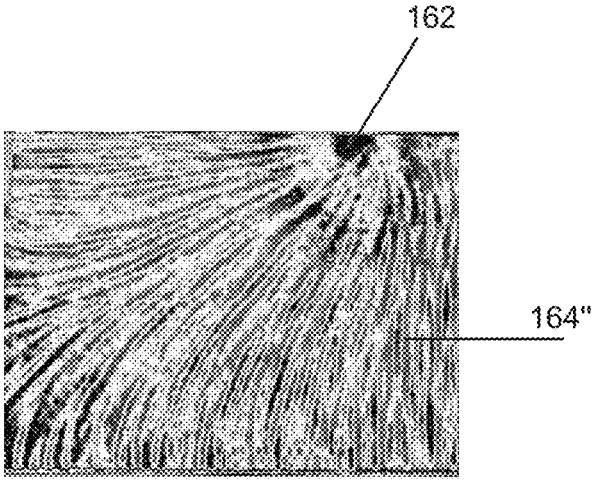
Figure 16A:
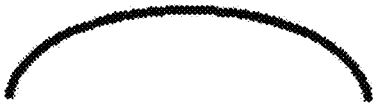
Figure 16B:
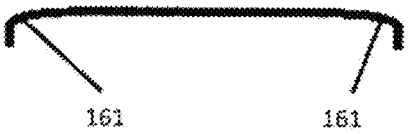
Figure 16C:
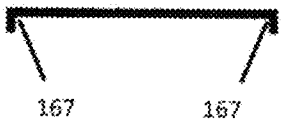

In the drawings,

FIG. 1 illustrates a schematic cross-sectional view of a separator device according to the prior art;

FIG. 2 illustrates a detail view of the separator device of FIG. 1 along the section A1;

FIG. 3*a* illustrates a schematic cross-sectional view of a counter electrode element according to the present invention;

FIG. 3*b* illustrates a top view of the counter electrode element of FIG. 3*a* from a direction B;

FIG. 4*a* illustrates a schematic cross-sectional view of two counter electrode elements according to the present invention;

FIG. 4*b* illustrates a top view of the counter electrode elements of FIG. 4*a* from a direction C;

FIG. 4*c* illustrates a schematic top view of a counter electrode according to another embodiment;

FIG. 4*d* illustrates a top view of a counter electrode according to another embodiment;

FIGS. 5*a* to 5*d* illustrate schematic representations of different embodiments of an emitter electrode with a respective drip element;

FIG. 6*a* illustrates a schematic representation of an emitter electrode with an approach flow element according to the present invention with a drip element;

FIG. 7 illustrates a schematic cross-sectional view of an emitter electrode according to another embodiment;

FIG. 8 illustrates a schematic cross-sectional view of a separator device according to the present invention, in which a partition film according to the present invention is used;

FIG. 9 illustrates a schematic cross-sectional view of a support element with a drain device;

FIG. 10 illustrates a schematic cross-sectional view of an alternative support element with a drain device;

FIG. 11 illustrates a schematic cross-sectional view of a separator device according to the present invention with the use of a drainage element in the form of a conductive mesh;

FIG. 12 illustrates a schematic cross-sectional view of another embodiment of a device according to the present invention for performing a method according to the present invention;

FIG. 13 illustrates a schematic cross-sectional view of an influencing device in the form of a metal solid body;

FIG. 14 illustrates a schematic top view of the alternately-arranged paired rows of the emitter electrode and the influencing devices;

FIG. 15*a* illustrates a simulated figure of the electric field in the vicinity of the emitter electrode without a grounded end face of the influencing devices;

FIG. 15*b* illustrates a simulated figure of the electric field in the vicinity of the emitter electrode with a grounded end face of the influencing devices; and FIGS. 16*a* to 16*c* illustrate schematic representations of the cross-sectional profile in difference embodiments of the influencing devices.

FIG. 3*a* depicts a schematic cross-sectional view of a counter electrode element 31 in a schematic cross-sectional view. FIG. 3*b* depicts a top view of the counter electrode element 31 from the direction B in FIG. 3*a*.

As can be seen in FIGS. 3*a* and 3*b*, the counter electrode element 31 has a plurality of plateau regions 33. The plateau regions 33 are arranged coaxially to an emitter electrode 11, which extends along an axis X. The plateau regions 33 are connected to a base level 37 by means of spacer elements 35. As described previously and explained below, other configurations may also be implemented in order to achieve the spacing apart. An electrical connection between the plateau region 33 and the spacer element 35 is produced via a connecting element 39.

As can be seen, in particular, in FIG. 3*a*, the spacer element 35 does not run coaxially to the axis X, but rather parallel thereto. Embodiments that are not shown provide that the spacer element runs coaxially to the axis X, so that the counter electrode element is configured so as to be "mushroom-shaped." As can also be seen in FIG. 3*a*, the plateau region 33 has a curvature.

Therein, in a preferred embodiment (not shown), the curvature is configured, in particular, in an edge region of the plateau region, whereas the central region of the plateau region is flat. This ensures that a stable and broadest-possible plasma cone is formed, while simultaneously also ensuring that, in particular, liquid contaminants will not accumulate on the plateau region, but rather flow off therefrom. The viscosity of the contaminants causes liquid contaminants present at the edge of the plateau region to "entrain" contaminants present in the small region.

This off-flow of contaminants is furthermore supported by the formation of an "ion wind" in the region of the plasma cone—both adjacent thereto and in the interior—that causes these contaminants to be "blown away" from the plateau region, in particular, from the flat region.

The plateau region 33 also ensures that a predetermined shape of a plasma cone 41 will form. It is also ensured that contaminants diverted in the direction of the counter electrode element 31 via the plasma cone 41 can flow directly off from the plateau region 33, in particular, cannot collect in the plateau region and agglomerate and thus lead to contamination of the counter electrode.

The C-shaped cross-sectional shape of the counter electrode element 31, which can be seen in FIG. 3*a*, makes it possible to combine two counter electrode elements with each other, as depicted in FIG. 4*a*. As can be seen, in particular, in FIG. 4*b*, the counter electrode elements 31 may be arranged with mirror symmetry and slightly offset from one another. This makes it possible for the plateau regions 33 of the respective counter electrode elements 31 to be arranged offset from one another, so that same can each be positioned coaxially to corresponding emitter electrodes 11. Due to the offset arrangement of the counter electrode elements 31, the respective plasma cones 41 can be formed offset from one another, so as to produce a nearly closed "plasma wall" for the gas flow.

In an alternative embodiment (not shown), it may be provided that the two counter electrode elements depicted in FIG. 4*a* are not configured completely identically, but rather have spacer elements 35 of different heights. This creates the ability to arrange the base levels so as to overlap with one another, and simultaneously ensures that the plateau regions 33 are arranged at the same height. Therewith, the plateau regions are evenly spaced apart from the emitter electrodes, and a uniform "plasma wall/plasma cone" can be formed.

FIGS. 4*c* and 4*d* depict alternative embodiments of counter electrode elements 31', 31". The drawings each depict schematic top views of the counter electrode elements 31', 31". The counter electrode elements 31', 31", too, have plateau regions 33', 33". The plateau regions 33' of the counter electrode element 31' are, however, arranged in the shape of a chain, whereas the plateau regions 33" of the counter electrode element 31" are arranged in the shape of a matrix. This signifies that not every single plateau region 33', 33" is separated from the base level by a spacer element, but rather only plateau regions 33', 33" respectively arranged in the edge region of the counter electrode elements 31', 31" are spaced apart from the base level by suitable spacer elements. The remaining plateau regions 33', 33" are interconnected, or connected to one another with the plateau regions 33' arranged at the edge via connecting devices 43'.

The connecting devices 43', 43" are configured as conductive elements that, however, have a smaller extent than the plateau regions 33', 33" in at least one spatial direction. This causes the plasma cones to form substantially between the plateau regions 33', 33" and the respective emitter electrodes. The plateau regions 33', 33", due to this connection thereof, span an otherwise empty region between the counter electrode elements 31', 31" and the base level.

The counter electrode elements 31', 31" may be configured as punched sheet metal parts. This ensures that the plateau regions 33', 33" are arranged substantially in the same plane, and, at the same time, makes it easy in terms of construction to produce the counter electrode elements 31, 31".

This construction ensures that through the substantially barrier-free space below the counter electrode elements 31', 31", the discharge of contaminants separated off in the plasma separator is facilitated. The contaminants can also be more easily transported away from the counter electrode. Preferably here, the region under the counter electrode elements is electroconductively lined and grounded and thus serves as an additional option for separating off the contaminants that pass by the plateau region.

FIGS. 5*a* to 5*d* depict different embodiments of emitter electrodes, 51, 53, 55, and 57. These emitter electrodes are alike in each having a drip element.

Figure 5A:
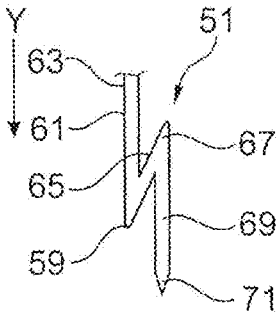

For example, FIG. 5*a* shows that the emitter electrode 51 has at least one kink 59. The kink 59 constitutes a drip element. The kink 59 subdivides the emitter electrode 51 into different electrode regions. In a first electrode region 61, the emitter electrode 51 extends from an infeed end 63 along the axis Y. The kink 59 is followed by a second electrode region 65 in which the emitter electrode 51 has a direction component that runs against the Y-axis. A further bending 67 is followed by a third electrode region 69 in which the emitter electrode 51 again extends in the direction of the axis Y.

This causes the electrode end 71, from which the plasma cone forms, to be arranged below the drip element 59. If, now, there should be particles—in particular, oil particles—driven by an ion wind that collect on the emitter electrode 51, in particular, the electrode region 61, or flow from the support element into the electrode region 61, then the fluid drops gather in the region of the drip element 59 until they come loose from the emitter electrode 51 due to the force of gravity and move in the direction of the counter electrode, in particular, so as to be accelerated by the plasma. This prevents, in particular, the contaminants from being able to collect in the region of the electrode end 71 and being able to lead to charring there.

Figure 5B:
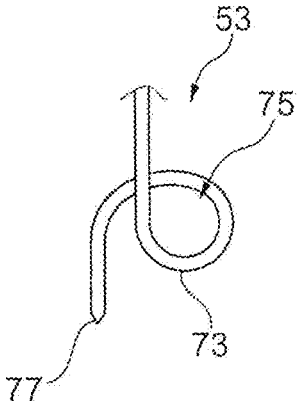

FIG. 5*b* depicts another embodiment of an emitter electrode 53 with a drip element 73. In the emitter electrode 53, the drip element is formed by the lower region of a winding 75. In this embodiment, the electrode end 77 is located upstream of the gas flow, so that after having dripped from the drip element 73, the fluid drops are prevented from being able to move again in the direction of the electrode end 77 and accumulate there again.

Figure 5C:
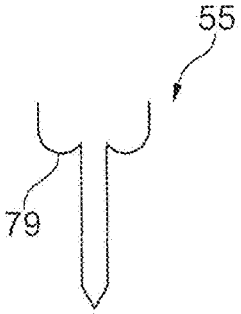

With the emitter electrode 55 depicted in FIG. 5*c*, a drip element 79 is formed by an annular bulge in the upper region of the emitter electrode 55. The drip elements 79 are shaped, in particular, by a bulge configured on the surface of the emitter electrode 55. In particular, a bulge may be formed by a "bulbous coating" that comprises, for example, plastic, ceramic, metal, or rubber. The bulge may also have a plurality of annular bulges around the tip, in addition or as an alternative.

Figure 5D:
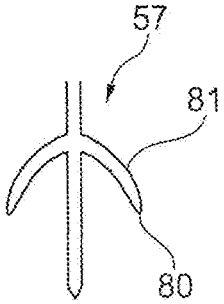

With the emitter electrode 57 depicted in FIG. 5*d*, a drip element 81 is formed by a disc element 81 of the emitter electrode 57. Then, the disc element 81 is configured in the form of a shield element.

The configuration of a drip element is not limited to the shaping of the emitter electrode, however. As can be seen in FIG. 6*a*, the present invention also proposes that an approach flow element 85 be configured in the region of an emitter electrode 83. The approach flow element 85 causes fluid droplets collecting on the surface of the support element 87 to be unable to reach the emitter electrode 83, but rather to be guided along the approach flow element 85 to a drip element 89.

The drip element thus prevents contamination of the electrode end 90, which could cause the contaminants to be baked in and thus cause charring of the electrode tip, which could lead to a collapse of the plasma.

FIG. 7 illustrates a cross-sectional view of another embodiment of an emitter electrode 91. The emitter electrode 91 has a taper 95 at the electrode end 93. This taper 95 is formed by configuring the emitter electrode 91 in the region of the electrode end 93 to be regionally hollow, in particular, in the shape of a hollow cylinder. In other words, the emitter electrode 91 has an annular tip at the electrode end 93.

This constitutes an annular taper 95 on the electrode end 93. This also effectively prevents contamination of the electrode end 93. If, for example, there occurs a contamination, for example, a drop, that runs down along the emitter electrode 91, then same reaches this region of the taper 95, stripping away the plasma in this region of the emitter electrode 91. The plasma cone then, however, wanders along the taper 95 to another part of the circle, until the fluid droplet comes loose and is discharged so as to be accelerated via the plasma of the counter electrode. Depending on the wandering of the contamination on the electrode end, thus, the plasma cone wanders along the taper, preventing the contamination from overheating and baking in on the electrode end or the plasma from detaching from the electrode 91.

FIG. 8 depicts another embodiment of a separator device 101 according to the present invention. The elements of the separator device 101 that correspond to those of the separator device 1 bear like reference signs, but increased by 100. In contrast to the separator device 1, the counter electrode elements depicted in FIGS. 3*a* to 4*b* is used as a counter electrode 109 in the separator device 101.

Moreover, the gas flow 107 is separated from the region in which the emitter electrodes 111 are located by means of a partition element, in the form of a partition film 123, that is permeable to the plasma or electrons. The partition film 123 entails, in particular, a Teflon film. This has the property of being gas-impermeable for the gas flow 107, but permeable to the electrons supplied by means of the emitter electrodes 111. In other words, the partition film 123 prevents the gas flow 107 from being able to penetrate into the region of the emitter electrodes 111 and from being able to cause unwanted contamination there. At the same time, it is ensured that there can be achieved an efficient separating off of contaminants from the gas flow in the direction of the counter electrodes 109 by means of the low-energy plasma, which is arranged through the plasma cone 125.

Experiments performed on separator devices known from the prior art have shown that the collection of contaminants in the region of the emitter electrodes is favored by there being an electrostatic charge in the region of a support element from which the emitter electrodes exit. Most often, the support element is made of a ceramic material. The present invention now proposes that drainage elements reduce an electrostatic charge of the surface of the support element.

FIG. 9 depicts a first embodiment of such a drainage element. The support element 131 is composed of a ceramic material in which, however, a drainage element 133 in the form of a conductive mesh is embedded. The mesh 133 causes charge carriers collecting on the surface of the support element 131 to be discharged, i.e., an electrostatic charge of the surface of the support element 131 is prevented in such a manner that contaminants cannot collect in the region of the emitter electrodes 135. Furthermore, a drainage element is formed by the configuration of a depression 137 between each of the electrodes 135. This shaping supports the discharge of the charge carriers due to the electrical conductivity of the material, and increases the resistance against the contaminants reaching the support element.

FIG. 10 depicts another embodiment of a drainage element. The support element 131' comprises a drainage element 133' in the form of a coating applied to the support element 131'. The coating 133' is placed at the same electrical potential as the emitter electrodes 135', and thus prevents an electrostatic charge.

A corresponding drainage element 133" may, as depicted in FIG. 11, also be implemented in the form of a mesh which is spaced apart from the support element 131" and through which the emitter electrodes 135" pass. In order to prevent an electrostatic charge of the surface of the support element 131", the same electrical potential is applied to the mesh 133" as to the emitter electrodes 135". Furthermore, the distance between the emitter electrodes 135" and the mesh or the projection of the emitter electrode 135" through the mesh is selected so that the plasma is ignited not between the mesh and emitter electrode 135" but rather between the emitter electrode 135" and the counter electrode.

As depicted in FIG. 8, the inner region of a separator device 101 is surrounded by a support element 119, a wall 139 in which an inlet opening 141 connecting to the inlet line 103 is configured, a second wall 143 in which an outlet opening 145 connected to the outlet line 105 is arranged, and a third wall 147 that is configured under the counter electrodes 109.

In other embodiments, it may be provided that the drainage elements 133, 133', 133" extend not only in the region of the support element 131, 131', 131" but also are arranged in the region of the first wall 139, the second wall 143, and/or the third wall 147. In this manner, there forms a "Faraday cage" that prevents additional electrical fields within the separator device that could lead to influencing of the ion wind and to attraction of contaminants to the walls. Thus, all of the walls are at the same potential, in particular, ground potential, so as to prevent an attractive force between the walls and the corresponding contaminants. Surface charges can be removed immediately, in particular, when the drainage elements are connected to ground. To achieve these drainage elements, for example, the intake and outlet routes of the separator device may comprise a conductive material or at least one conductive coating. The housing may also comprise entirely a conductive material or a conductive coating. Here, however, a conductive coating is preferred. Thus, for example, a poorly thermoconductive material may be provided with a suitably electrically conductive coating. This prevents—at least, reduces—the formation of condensation on the inner walls of the separator device when the separator device is cooled off.

Further experiments performed on the separator devices known from the prior art have shown that detrimental turbulence of the blow-by flow in the inner region of a separator device 101 occurs, wherein, in particular, the turbulence causes the blow-by to reach the region of the emitter electrodes. The swirling of the blow-by flow in the region of the emitter electrodes makes it possible for the particles entrained by the blow-by to follow along the upper wall of the separator device to the emitter electrode, thus collected at the tips of the emitter electrodes in the upper region of the separator device. Contamination of the emitter electrodes may impair the functionality of the separator device.

The present invention now proposes that influencing devices installed between groups of emitter electrodes in the upper region of the separator device influence the electric field formed by the emitter/second electrodes and first electrodes/counter electrodes in such a manner that the ion winds are conducted through the modified electric field so as no longer act detrimentally. The detrimental turbulence of the blow-by should no longer occur, or at least be reduced. This causes no blow-by to flow along the covering to the emitter electrodes, allowing the tips of the emitter electrodes in the upper region of the separator device to remain clean for longer.

FIG. 13 depicts a first embodiment of such an influencing device 160 in a separator device in the form of a metallic solid body having a substantially C-shaped profile. Therein, the influencing devices 160 are each integrated in the separator device 101 in alternation with a group 165 of emitter electrodes 162 arranged in two rows, wherein the region 168 of the influencing device 160 that runs along the upper wall of the separator device 101 is integrally connected via a connecting region 161 (in particular, a concave one) to the region 169 of the influencing device 160 that runs along the side walls of the separator device. In the lower region, the influencing device 160 is conductively connected to the region 168 of the influencing device 160 of the opposite counter electrodes 163'.

FIG. 14 illustrates a schematic top view of the upper region of the separator device 101, which comprises groups 165 comprising two rows of two emitter electrodes 162 and influencing devices 160. It should be noted here again how the emitter electrodes 162, designed so as to be grouped into two respective rows in the illustrated embodiment of the separator device 101 in FIG. 14, each extend in alternation with an influencing device 160 according to the present invention transversely in the upper region of the separator device 101. Then, an influencing device 160 in the form of a substantially C-shaped insert is continuously repeatedly placed between each two electrode rows 162, in order to be able to protect as much as possible all of the electrode tips through the positive effect of this solution. A distance d between a group 165 of emitter electrodes 162 and the influencing device 160 is herein selected to be so large that there can be no sparking from the emitter electrodes 162 to the influencing device 160.

FIG. 15*a* illustrates a schematic representation of the field line profiles of the electric field 164' that is formed by the emitter electrode 162 and the counter electrode (not shown) that is situated in the lower region of the image, if no influencing devices according to the present invention with grounded end face are provided in the interior of the separator device 101. FIG. 15*b* illustrates a schematic representation of the field line profiles of the electric field 164" for the same emitter electrode 162. The electric field 164" forms between the emitter electrode 162 and the counter electrode (again, not shown) in the lower region. However, now an influencing device having grounded end faces is represented. Within the framework of different tests, it has been shown empirically that the field distribution of the electrode field 164" from FIG. 15*b* eliminates or at least reduces the occurrence of turbulence in the blow-by, because the ion winds are directed by the modified field shape of the electric field 164" so as to no longer adversely affect the blow-by. In particular, the end faces of the influencing devices 160 bring about a field shift. Thus, the particles are charged and separated off earlier, so that the degree of separation overall rises. This advantageously prevents any blow-by from flowing along the covering to the emitter electrodes 162, and thus allows the tips of the emitter electrodes 162 in the upper region of the separator device 101 to stay clean longer, because fewer particles are deposited on the emitter electrodes 162 than is the case with the field line profiles of the field 164' without influencing devices.

As described above, an influencing device 160 is provided respectively in alternation with a group comprising two rows of emitter electrodes 162 in the separator device 101, whereby all of the emitter electrode tips are provided to the greatest extent possible from deposits of blow-by particles due to the influencing device. Then, due to the repeating of the influencing device, the positive effect spreads to all of the emitter electrodes or groups of emitter electrodes. It shall be readily understood, however, that it is also possible to install only one single emitter electrode row in alternation with one influencing device, instead of the two emitter electrode rows mentioned here by way of example, or even to install three emitter electrode rows respectively in alternation with one influencing device, or to install a multitude of emitter electrode rows respectively in alternation with one influencing device. A person skilled in the art may, as a matter of course, also provide other arrangements of the emitter electrodes 162 within a group of emitter electrodes 165, instead of electrode rows.

With the device according to the present invention, the influencing devices 160 entail only the end flanks, such that a solid body such as is used in FIGS. 13 and 14 for the influencing devices constitutes an embodiment of the influencing devices 160 that is not necessarily compulsory. The devices 160 according to the present invention may, for example, also be implemented by using grounded metal sheets or the like. It is also not necessary to configure round connecting regions 161, such as are configured in FIGS. 13 and 14 with the influencing devices 160, in order to achieve the positive effect of the modified field distribution. The rounded connecting regions 161 present in FIGS. 13 and 14 serve, rather, to facilitate installation and facilitate manufacture. Moreover, other cross-sectional profiles of the influencing device according to the present invention—in particular, cross-sectional profiles in a plane perpendicular to the direction of flow of the blow-by—may be implemented without counteracting the positive effect.

For this purpose, FIG. 16*a* illustrates another possible cross-sectional shape of the influencing device 160 according to the present invention, which has a curved shape. FIG. 16*b* illustrates the substantially C-shaped form disclosed in FIG. 13 and FIG. 14, with the individually segment-connecting connecting regions 161. FIG. 16*c* depicts a third possible cross-sectional shape of the influencing device according to the present invention, wherein lateral continuations thereof branch off perpendicularly from the part that runs transversely in the upper region in the separator device 101, and thus have rectangular connecting regions 167 instead of curves.

FIG. 12 finally depicts a modification of a device according to the present invention that makes it possible to carry out a method according to the present invention. With the separator device 151, a support element 153 is present, wherein the emitter electrodes 155 are fastened by means of actuators 157 to the support element 153. The actuators 157 have piezoelectric elements that make it possible for the emitter electrodes 155 to be made to vibrate (ultrasonically). This makes it possible to clean the emitter electrodes by removing, by means of ultrasound, contaminants that have stuck to the emitter electrodes 155.

One embodiment (not shown) may provide that the emitter electrodes 155 may be formed of or at least comprise a shape memory alloy (SMA) material. The shape memory material causes deformation of the emitter electrode to occur when the temperature increases. This deformation causes the deformation of any contaminants or buildup that may be present on the emitter electrode in such a manner as to cause same to "flake off" from the surface.

The features disclosed in the preceding description, in the claims, and in the drawings may, both individually and in any combination, be essential for the invention in the various embodiments thereof.

LIST OF REFERENCE SIGNS

A1 Cut-out
N Normal direction
B, C Direction
X, Y Axis
D Distance
1 Separator device
3 Inlet line
5 Outlet line
7 Gas flow
9 Counter electrode
11 Emitter electrode
13 Connection
15 Collecting space
17 Partition elements
19 Support element
21 Thermoset body
31, 31', 31" Counter electrode element
33, 33', 33" Plateau region
35 Spacer element
37 Base level
39 Connecting element
41 Plasma cone
43', 43" Connecting device
51 Emitter electrode
53 Emitter electrode
55 Emitter electrode
57 Emitter electrode
59 Kink
61 Electrode region
63 Infeed end
65 Electrode region
67 Bending
69 Electrode region
71 Electrode end
73 Drip element
75 Winding
77 Electrode end
79 Drip element
80 Drip element
81 Disc element
83 Emitter electrode
85 Approach flow element
87 Support element
89 Drip element
90 Electrode end
91 Emitter electrode
93 Electrode end
95 Taper
101 Separator device
103 Inlet line
105 Outlet line
107 Gas flow
109 Counter electrode
111 Emitter electrode
113 Connection
115 Collecting space
119 Support element
121 Thermoset body
123 Partition film
125 Plasma cone
131, 131', 131" Support element
133, 133', 133" Drainage element
135, 135', 135" Emitter electrode
137 Depression
139 Wall
141 Inlet opening
143 Wall
145 Outlet opening
147 Wall
151 Separator device
153 Support element
155 Emitter electrode
157 Actuator
160 Influencing device
161 Connecting region
162 Emitter electrode
163, 163' Counter electrode
164', 164" Electric field
165 Group
167 Connecting region
168 Region
169 Region

The invention claimed is:

1. A device for separating off liquid and particulate contaminants from a gas flow, the device comprising:

at least one first electrode;

at least one second electrode;

a flow path of the gas flow runs between the at least one first electrode acting as a counter electrode and the at least one second electrode acting as an emitter electrode and having an electrode end oriented in a direction of the at least one first electrode;

wherein a direct-current voltage exceeding a breakdown voltage is applied between the at least one first electrode and the at least one second electrode in order to form a stable low-energy plasma, wherein the at least one second electrode extends substantially along a first axis in a first direction and each of the at least one first electrode has a plateau region which is arranged opposite the at least one second electrode and which extends in a first plane running substantially perpendicular to the first direction, wherein the plateau region is connected to a base level by a spacer element extending against the first direction, further wherein the plateau region is connected to the spacer element by at least one connecting element that runs substantially perpendicular to the first direction.

2. The device according to claim 1, wherein the plateau region is arranged coaxially to the at least one second electrode, and the flow path runs substantially between the at least one second electrode and the plateau region, wherein the plateau region has a surface that is curved in a direction of the at least one second electrode and against the first direction, wherein the plateau region is arranged a distance from the base level of the at least one first electrode in the direction of the at least one second electrode, and a plurality of second electrodes from the at least one second electrode are present, and each of the at least one first electrode has a corresponding plateau regions from the plurality of plateau regions from a plurality of first electrodes from the at least one first electrode, wherein each of the at least one second electrodes is associated with a corresponding one of the plateau regions.

3. The device according to claim 1, wherein the spacer element runs coaxially to the first axis, or the spacer element runs at a distance from the first axis, parallel to the first axis, and further wherein the at least one first electrode has a substantially C-shaped cross-section, the C-shaped cross-section being formed of the base level, the spacer element, the at least one connecting element, and the plateau region.

4. The device according to claim 2, wherein the plateau region, the spacer element, the base level, and the at least one connecting element are configured as a single piece;

wherein the corresponding ones of the plateau regions are connected by at least one connecting device that extends substantially parallel to the base level and has a lesser extension in at least one direction of the first plane than the corresponding ones of the plateau regions, wherein the corresponding ones of the plateau regions are arranged along a straight line in a direction perpendicular to the first axis, the at least one connecting device extends substantially along the straight line and a network is configured by the at least one connecting device, wherein at least one plateau region is arranged on at least one point of intersection of the at least one connecting device, wherein the network extends along the first plane.

5. The device according to claim 2, wherein each of the plateau regions are provided by at least one counter electrode element that is configured as a punched sheet metal part, the plateau regions are arranged in the at least one counter electrode element along a second direction and at least two of the at least one counter electrode elements arranged with mirror symmetry relative to one another, interlocking with one another, and offset from one another in such a manner that the plateau regions of the at least one counter electrode elements are arranged offset relative to one another along the second direction, or the punched sheet metal part forms the plateau regions and the at least one connecting element.

6. The device according to claim 1, wherein at least one drip element which is operatively connected to the at least one second electrode and by which fluid particles of the gas flow that are moving in the direction of the at least one second electrode are collected so that the fluid particles come loose from the at least one drip element at a distance from the electrode end.

7. The device according to claim 6, wherein the at least one drip element is encompassed by at least one approach flow element arranged in a region of the at least one second electrode.

8. The device according to claim 6, wherein the at least one second electrode encompasses the at least one drip element, wherein fluid particles flowing along the at least one second electrode in the direction of the electrode end are collected at a distance from the electrode end by the at least one drip element in such a manner that the fluid particles come loose from the at least one second electrode at a distance from the electrode end, wherein, the electrode end and an infeed end of the at least one second electrode that is opposite the electrode end are arranged offset from one another along a first axis (Y) extending in a first direction in such a manner that the electrode end is arranged close to the at least one first electrode, and the at least one drip element is formed by a transition region of the at least one second electrode that is arranged between a first electrode region—in which at least one surface region of the at least one second electrode and the electrode extends from the infeed end in the direction of the electrode end in a direction with a direction component along the first axis (Y)- and a second electrode region in which at least one surface region of the at least one second electrode and the at least one second electrode extends in a direction with a direction component against the first direction, wherein, at least one surface region of the at least one second electrode and the at least one second electrode extend from the infeed end in the direction of the electrode end, subsequently to the second electrode region, in a third electrode region in a direction with a direction component along the first axis (Y), in such a manner that the at least one drip element is arranged along the first axis above the electrode end.

9. The device according to claim 6, wherein the at least one drip element is encompassed by and constituted of at least one winding of the at least one second electrode, at least one kink of the at least one second electrode and an approach flow element, at least one helical region of the at least one second electrode, at least one protuberance of a surface of the at least one second electrode and the approach flow element, at least one skirt, and at least one disc element; the at least one drip element circumferentially surrounds the at least one second electrode; with radial symmetry, the at least one drip element is arranged downstream of the gas flow; and the approach flow element is arranged upstream of the gas flow; and the at least one drip element is configured integrally with the at least one second electrode and the approach flow element.

10. The device according to claim 1, wherein the at least one second electrode has a taper in a region of the electrode end.

11. The device according to claim 10, wherein the taper is configured in the form of at least one tip, at least one ridge, or at least one edge.

12. The device according to claim 10, wherein the at least one second electrode has a substantially cylindrical, triangular, quadratic, rectangular, or polygonal cross-sectional shape in a plane perpendicular to a main extension direction;

the at least one second electrode has an end surface inclined with respect to the main extension direction, in the region of the electrode end;

the taper is encompassed by an edge of the end surface;

the at least one second electrode has a hollow region in which the at least one second electrode is hollow;

wherein the taper is encompassed by at least one end edge of the wall of the hollow region;

the taper is circumferential on the electrode end;

the at least one second electrode comprises a carbon material in the region of the electrode end; and the at least one second electrode comprises at least one coating-that reduces the attachment of particles in the region of the electrode end.

13. The device according to claim 1, wherein a partition element is substantially impermeable to the gas flow and the particulate contaminants and is electrically and electrostatically permittive is arranged between the flow path and the at least one first electrode or between the flow path and the at least one second electrode.

14. The device according to claim 13, wherein the partition element comprises at least one partition film and comprises polytetrafluoroethylene;

wherein the partition element touches the at least one second electrode, the electrode end, or the at least one first electrode; and at least one discharge opening is provided in the partition element when the partition element is arranged between the at least one first electrode and the flow path, wherein the particulate contaminants that have been separated off from the gas flow-those that collect on the side of the partition element that faces the gas flow-are discharged by the at least one discharge opening into at least one collecting space.

15. The device according to claim 1, wherein the device comprises two second electrodes from the at least one second electrode, wherein the two second electrodes extend out from a support element, and a drain device is provided in order to reduce an electrostatic charge of the support element and to discharge charge carriers collecting on a surface of the support element, at least in a region between the two second electrodes.

16. The device according to claim 15, wherein the two second electrodes passes through the support element and that the support element comprise at least one ceramic element;

wherein the drain device comprises at least one drainage element that is installed on the support element and embedded in the support element, wherein the at least one drainage element comprises at least one drain coating, at least one drain fabric, and at least one metal band, and the drain device is configured as a conductive tunnel element, and the drain device comprises at least one depression configured in the support element.

17. The device according to claim 15, wherein the drain device comprises at least one drainage element arranged in a region between the electrode ends of the two second electrodes and the support element, wherein, the at least one drainage element comprises at least one conductive mesh, at least one conductive foam, at least one shield element that surrounds the two second electrodes and is curved radially outward in the direction of the electrode end, wherein, the at least one drainage element is at the same electrostatic potential as the two second electrodes, and wherein the drain device, the drain coating, and the at least one drainage element stretch along a first wall and second wall that extend(s) in a direction between the two second electrodes and the at least one first electrode in a direction along the first axis and opens into the at least one inlet opening or an outlet opening, and along a third wall that extends in parallel to the support element, below the at at least first electrode, and on the side of the at least one first electrode that faces away from the two second electrodes.

18. The device according to claim 15, wherein the device comprises at least one influencing device for influencing an electrical field formed by the two second electrodes and arranged between the two second electrodes.

19. The device according to claim 18, wherein the influencing device is arranged substantially opposite the at least one first electrode such that an electric potential is applied.

20. The device according to claim 18, wherein the influencing device is conductively connected to the at least one first electrode, the potential of the at least one first electrode is applied to the influencing device, or the drain device.

21. A method for operating the device according to claim 1, wherein the liquid and particulate contaminant-containing gas flow is supplied to the device, the gas flow is guided at least partially along the flow path configured between the at least one first electrode and the at least one second electrode in order to separate the liquid and particulate contaminants from the gas flow, and the direct-current voltage exceeding the breakdown voltage is configured between the at least one first electrode and the at least one second electrode in order to form the stable low-energy plasma, characterized in that the method furthermore comprises a cleaning step for cleaning either one or both of the at least one first electrode and the at least one second electrode.

22. The method according to claim 21, characterized in that during the cleaning step, a ground potential is applied to at least a first group of a plurality of the at least one second electrodes, or a voltage that exceeds the direct-current voltage and produces a breakdown between the at least one first electrode and the at least one second electrodes of the at least first group is applied, while the direct-voltage for forming the stable low-energy plasma is applied to at least one second group of the at least one second electrodes, wherein the at least one second electrode are alternately associated with the at least first group and the at least one second group.

23. The method according to claim 21, characterized in that in the cleaning step, a mechanical excitation of either one of both of the at least one first electrode and the at least one second electrode is produced, by an ultrasonic vibration produced by anyone or combination of at least one excitation device, wherein at least one piezoelectric element and at least one component of an internal combustion engine and a vibration transfer device operatively connected to a component of the internal combustion engine in order to transfer vibrations used as the at least one excitation device, and the cleaning step comprises a sequential departure of either one of both of at least two first electrodes and two second electrodes by a cleaning element that is at least one brush.

* * * * *